US007377789B1

(12) United States Patent
Liu

(10) Patent No.: US 7,377,789 B1
(45) Date of Patent: May 27, 2008

(54) ELECTRICAL CONNECTOR

(75) Inventor: Yu-Chiao Liu, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/651,473

(22) Filed: Jan. 10, 2007

(51) Int. Cl.
*H01R 9/09* (2006.01)

(52) U.S. Cl. ..... 439/66; 439/71; 439/83; 439/862

(58) Field of Classification Search ..... 439/66, 439/71, 862, 83, 876
See application file for complete search history.

(56) References Cited

U.S. PATENT DOCUMENTS 3,697,926 A * 10/1972 Krafthefer ..... 439/75
5,655,913 A * 8/1997 Castaneda et al. ..... 439/66
5,984,693 A * 11/1999 McHugh et al. ..... 439/66
6,227,869 B1 * 5/2001 Lin et al. ..... 439/66
6,296,495 B1 10/2001 Wang et al.
6,843,662 B2 * 1/2005 Ju ..... 439/83
6,984,130 B2 * 1/2006 Richter et al. ..... 439/66
7,029,287 B2 * 4/2006 Matsunaga et al. ..... 439/65
7,052,284 B2 * 5/2006 Liao et al. ..... 439/66
7,147,489 B1 * 12/2006 Lin ..... 439/83
2003/0186571 A1 * 10/2003 Lin ..... 439/83
2004/0132319 A1 * 7/2004 Richter et al. ..... 439/66

* cited by examiner

*Primary Examiner*—Gary F. Paumen
(74) *Attorney, Agent, or Firm*—Rosenberg, Klein & Lee

(57) ABSTRACT

An electrical connector includes an insulating body, and a plurality of pins received in the insulating body. The pin has a main portion and a flexible arm. Two separate supporting arms extend upwards from main portion. The flexible arm extends along the lengthwise direction of the main portion. There is a slot opening between the two supporting arms. The flexible arm is compressed and passes through the slot opening. Compared to the prior art, the structure of the electrical connector of the present invention is simple, and the pins can be disposed in a dense manner.

5 Claims, 5 Drawing Sheets

ELECTRICAL CONNECTOR

BACKGROUND OF THE INVENTION

1. Field of the Invention

The present invention relates to an electrical connector.

2. Description of the Related Art

U.S. Pat. No. 6,296,495 discloses an electrical connector. Its pin 5 is formed by punching the metal material belt. Reference is made to FIG. 1. The electrical connector has a horizontal welding base portion 50 for welding the pin 5 to a circuit board (not shown in the figure) so that the pin 5 is electrically connected with the circuit board. The base portion 50 includes a rear portion 501 and a front portion 503. A flexible arm 52 extends forwards and upwards from the rear portion 501 of the base portion 50. The flexible arm 52 can be electrically connected with a plate grid array module. A connecting portion 54 extends forwards and upwards from the front portion 503 of the base portion 50. A board-shaped fastening portion 56 extends from the front end of the connecting portion 54. The upper end of the fastening portion 56 diverges and has two fastening arms 561. On the opposite two sides of the fastening arms 561, there are a plurality of protruding splinters 562 for fastening the pin 5 onto an insulating body (not shown in the figure). However, because the base portion 50 and the flexible arm 52 of the pin 5 transversely extend, it is not easy to dispose the pins on the electrical connector in a dense manner.

SUMMARY OF THE INVENTION

One particular aspect of the present invention is to provide an electrical connector. The pins are densely disposed on the electrical connector, and the structure of the electrical connector is simple.

The electrical connector includes an insulating body, and a plurality of pins received in the insulating body. The pins have a main portion and a flexible arm. Two separate supporting arms extend upwards from the main portion. A flexible arm extends along the lengthwise direction of the main portion. There is a slot opening between the two supporting arms. The flexible arm is compressed and passes through the slot opening.

Compared to the prior art, the structure of the electrical connector of the present invention is simple, and the pins can be disposed in a dense manner.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
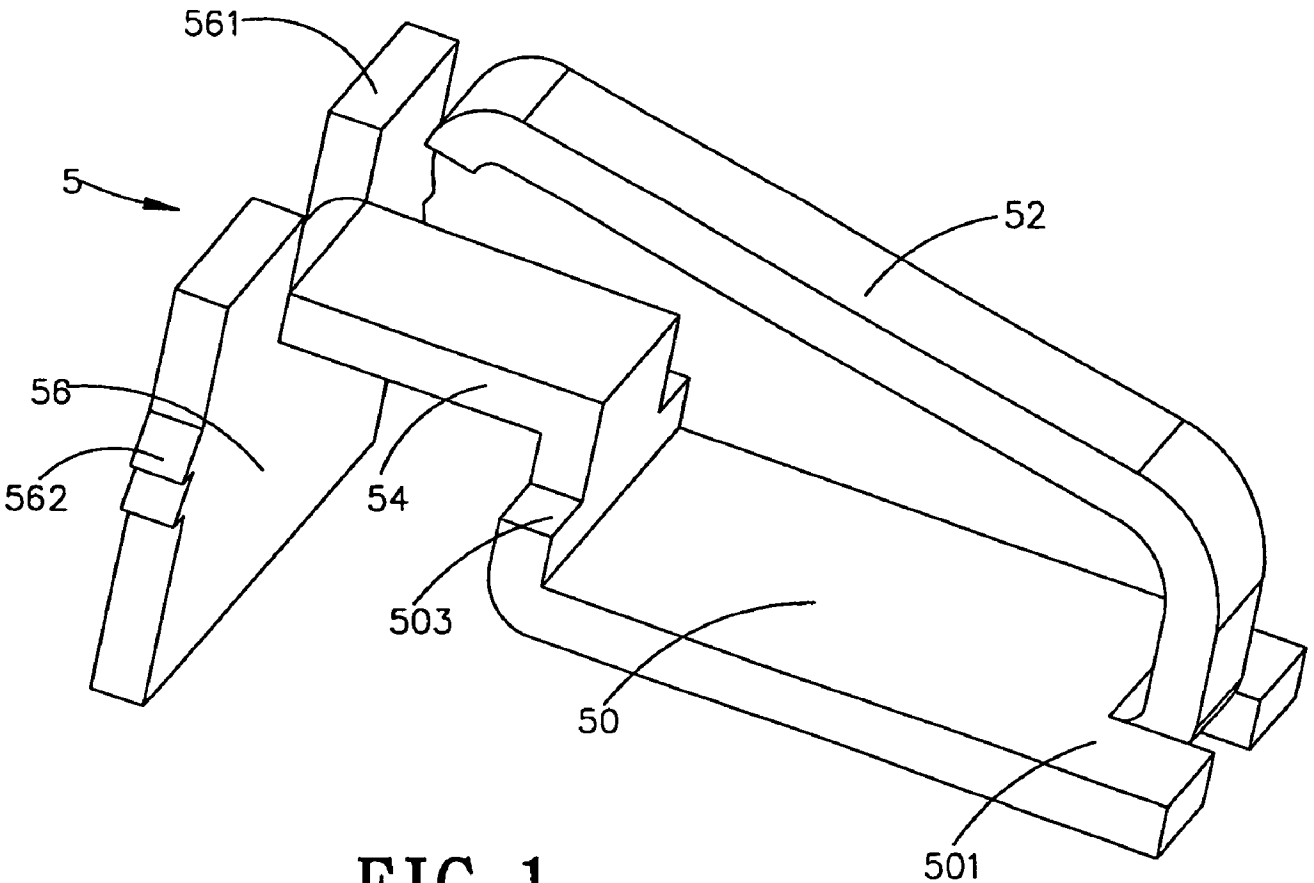
FIG. 1 PRIOR ART
FIG. 1 is a perspective view of the pins of the electrical connector of the prior art.
Figure 3:
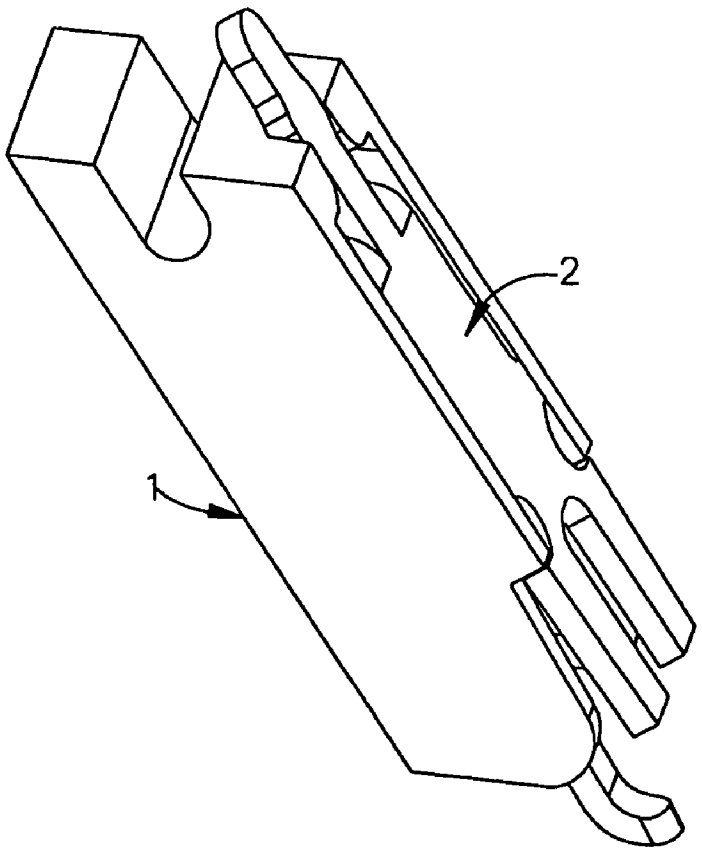
FIG. 3 is another assembly perspective view of FIG. 2.
Figure 2:
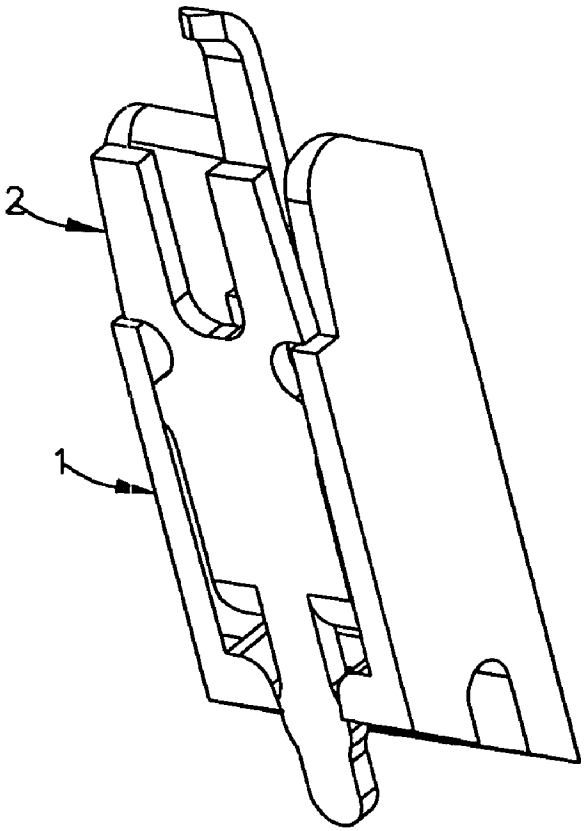
FIG. 2 is an assembly perspective view of the insulating body and the pins of the electrical connector of the present invention.
Figure 5:
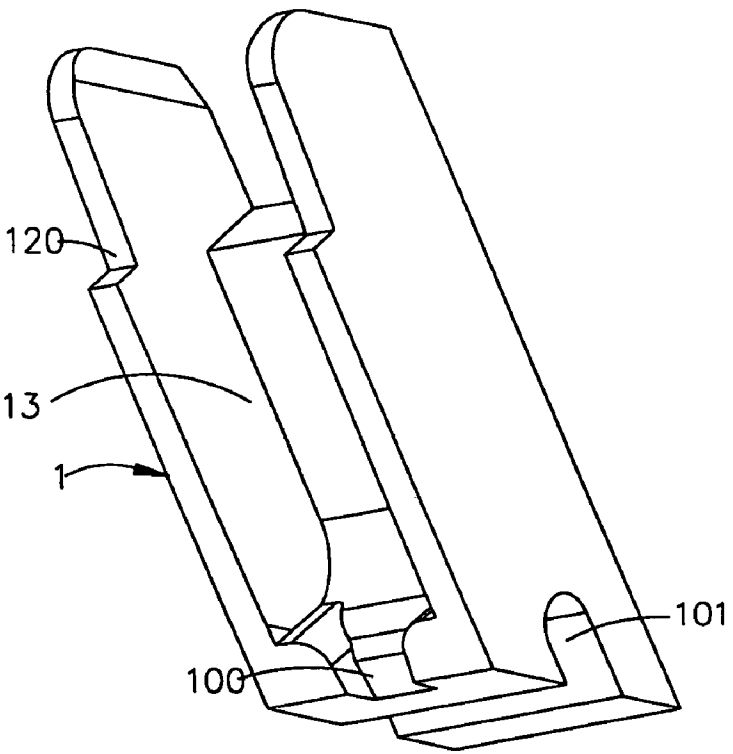
FIG. 5 is another perspective view of FIG. 4.
Figure 4:
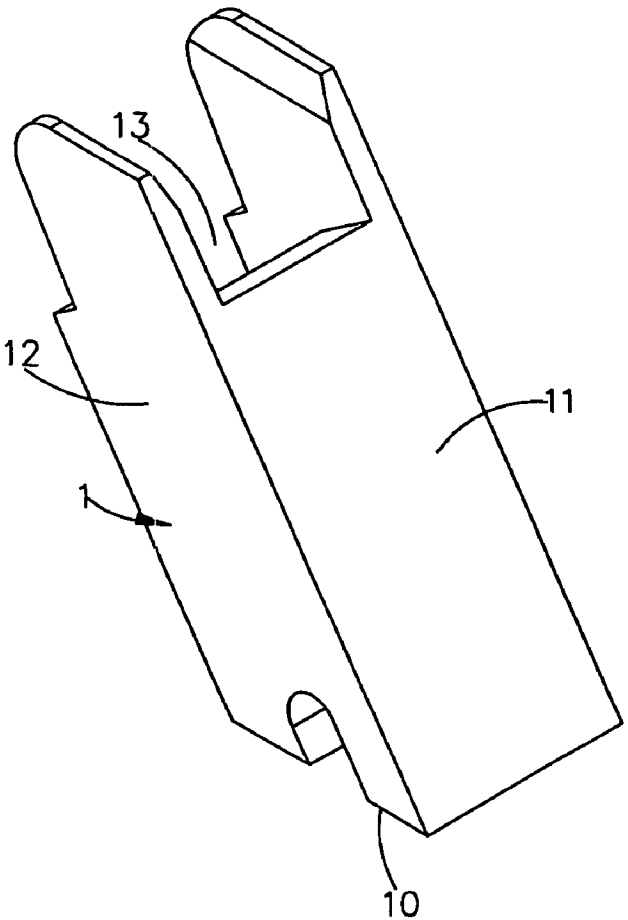
FIG. 4 is a perspective view of the insulating body of the electrical connector of the present invention.
Figure 7:
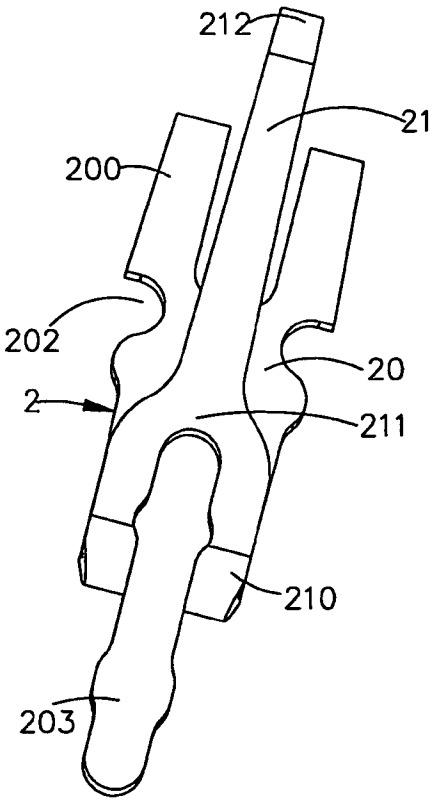
FIG. 7 is another perspective view of FIG. 6.
Figure 6:
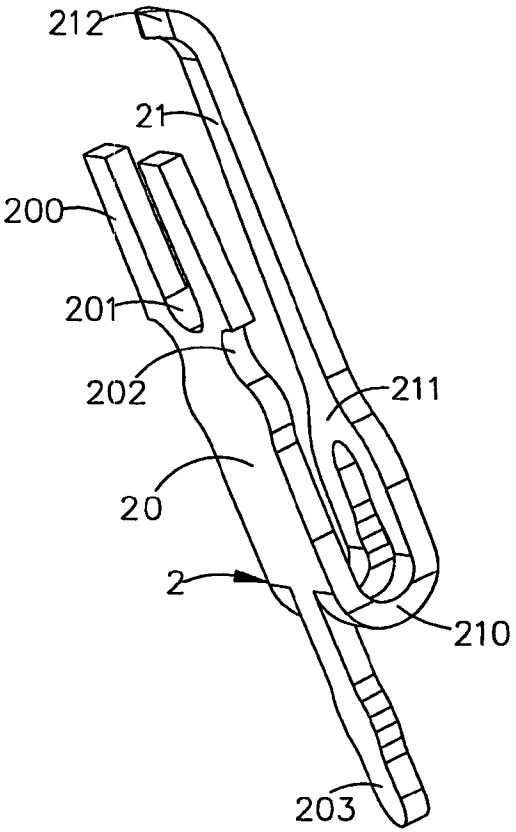
FIG. 6 is a perspective view of the pins of the electrical connector of the present invention.
Figure 8:
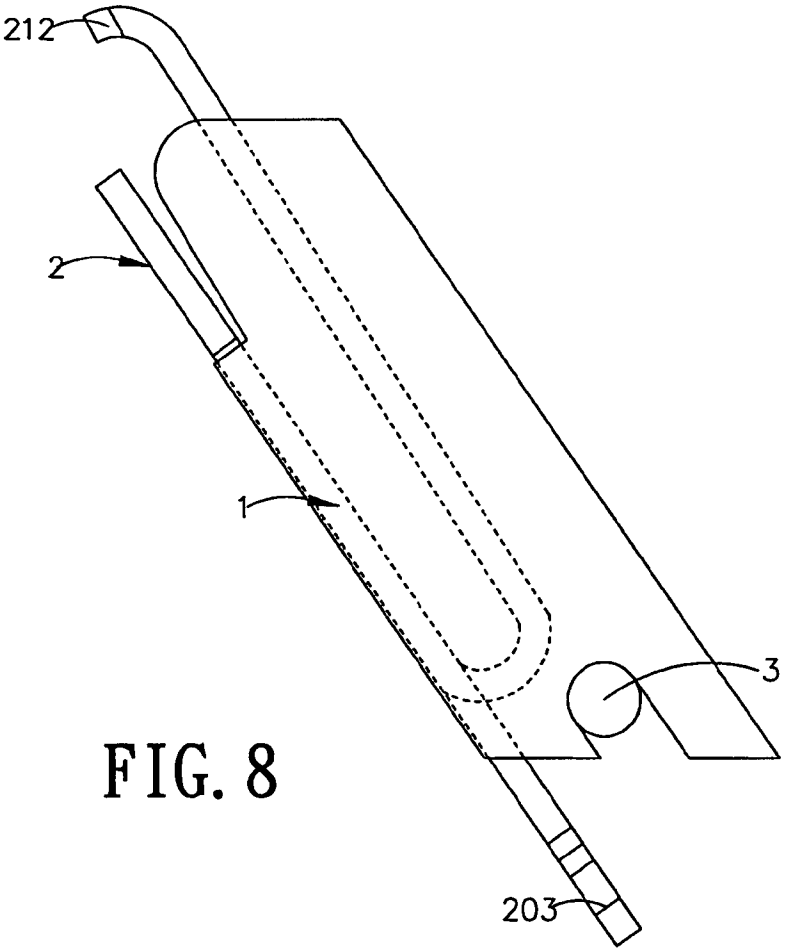
FIG. 8 is a front view of the electrical connector of the present invention installed with a solder ball.

Reference is made to FIGS. 2~8. The electrical connector includes an insulating body 1, and a plurality of pins 2 received in the insulating body.

Viewed from the side of the insulating body 1, the insulating body 1 has a parallelogram shape. The insulating body 1 includes a bottom wall 10, a rear wall 11, and a side wall 12. These three walls form a pin-receiving space 13. On the bottom wall 10, there is an opening 100 passing through the bottom wall 10. The pin 2 passes through the opening 100 and is welded onto the circuit board (not shown in the figure). Furthermore, on the lower surface of the bottom wall 10, there is a holding slot 101 for the solder ball 3. On the upper portion of the side wall 12, there is a pin stop-opening 120 for preventing the pin from moving down excessively.

The pin 2 includes a main portion 20 and a flexible arm 21 extending from the main portion 20. Two separate supporting arms 200 extend vertically and upwards from the upper portion of the main portion 20. The end of the supporting arm 200 connects with a material belt. There is a slot opening 201 between the two supporting arms 200. The flexible arm 21 is compressed and passes through the slot opening 201. There is a push-stop portion 202 protruding from the side of the supporting arm 200. The push-stop portion 202 is wedged to the stop-opening 120 of the insulating body 1 to prevent the pin from moving down excessively. Furthermore, on the middle portion of the lower edge of the main portion 20, a guiding-connecting portion 203 extends vertically and downwards. The guiding-connecting portion 203 is welded onto the surface of the circuit board (not shown in the figure) so that the pin 2 is electrically connected with the circuit board. The guiding-connecting portion 203 does not directly contact the solder ball 3 located in the holding slot 101 of the insulating body 1 until the solder ball 3 is melted and drops onto the guiding-connecting portion 203. Two curved portions 210 extend from the lower edge of the two sides of the main portion 20. The two curved portions 210 are located on two sides of the guiding-connecting portion 203. This means that the guiding-connecting portion 203 is located between the two curved portions 210. The two curved portions 210 are connected with a connecting portion 211. The flexible arm 21 extends upwards along the lengthwise direction of the connecting portion 211. The end of the flexible arm 21 bends and extends to form a contacting portion 212 for elastically contacting the chip module.

When the electrical connector is assembled, the pin 2 is put in the pin-receiving space 13 of the insulating body 1 so that the push-stop portion 202 of the pin 2 is wedged to the lower end of the stop-opening 120 of the insulating body 1. The pin 2 passes through the opening 100 so that the electrical connector is welded onto the circuit board.

Compared to the prior art, the structure of the electrical connector of the present invention is simple, and the pins can be disposed in a dense manner.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An electrical connector, comprising:

an insulating body; and a plurality of pins received in the insulating body;

wherein the pin has a main portion and a flexible arm, two separate supporting arms extend upwards from the main portion, the flexible arm extends along the lengthwise direction of the main portion, there is a slot opening between the two supporting arms, the lower edge of the main portion bends and extends to form curved portions, a guiding-connecting portion extends downwards from the main portion, and the guiding-connecting portion is located between the two curved portions.

2. The electrical connector as claimed in claim 1, wherein a push-stop portion protrudes from a side of the pin, and the push-stop portion wedges to the insulating body.

3. The electrical connector as claimed in claim 1, wherein the guiding-connecting portion is welded to a surface of a circuit board.

4. An electrical connector, comprising:

an insulating body; and a plurality of pins received in the insulating body;

wherein the pin has a main portion and a flexible arm, a guiding-connecting portion extends downwards from the main portion, two separate supporting arms extend upwards from the main portion, the flexible arm extends along the lengthwise direction of the main portion, there is a slot opening between the two supporting arms, and the flexible arm is adapted to be compressed and pass through the slot opening, wherein a holding slot is located on the lower side of the insulating body, a solder ball received in the holding slot does not contact the guiding-connecting portion of the pin until the solder ball is heated and melted.

5. The electrical connector as claimed in claim 4, wherein the curved portions are connected with a connecting portion, and the connecting portion extends upwards to form the flexible arm.

* * * * *